US008286810B2

(12) United States Patent
Sabounjian

(10) Patent No.: US 8,286,810 B2
(45) Date of Patent: Oct. 16, 2012

(54) LAUNDRY RACK

(75) Inventor: Azad Sabounjian, Irvine, CA (US)

(73) Assignee: Pro-Mart Industries, Inc, Irvine, CA (US)

( * ) Notice: Subject to any disclaimer, the term of this patent is extended or adjusted under 35 U.S.C. 154(b) by 317 days.

(21) Appl. No.: 12/703,642

(22) Filed: Feb. 10, 2010

(65) Prior Publication Data

US 2011/0192811 A1 Aug. 11, 2011

(51) Int. Cl.
*A47F 43/00* (2006.01)

(52) U.S. Cl. ..... 211/200

(58) Field of Classification Search ..... 211/200, 211/201, 205, 196, 182, 189; 248/164, 431; 403/326, 329, 331; 24/614, 615, 616
See application file for complete search history.

(56) References Cited

U.S. PATENT DOCUMENTS

| | | | | | |
|---|---|---|---|---|---|
| 482,269 | A | * | 9/1892 | North | 211/202 |
| 1,138,498 | A | | 5/1915 | Moore | |
| 1,533,470 | A | | 4/1925 | Schmitt | |
| 1,692,704 | A | | 11/1928 | Rohrig | |
| 2,310,770 | A | | 2/1943 | Evans | |
| 2,388,637 | A | * | 11/1945 | John | 211/170 |
| 2,393,606 | A | | 1/1946 | Brush | |
| 2,415,784 | A | | 2/1947 | Block | |
| 2,706,829 | A | | 4/1955 | Charnin | |
| 3,133,645 | A | * | 5/1964 | Cecil | 211/202 |
| 3,236,387 | A | * | 2/1966 | Perini | 211/42 |
| 3,850,534 | A | * | 11/1974 | O'Halloran | 403/190 |
| 3,891,334 | A | * | 6/1975 | Loikitz | 403/234 |
| 3,893,774 | A | * | 7/1975 | Hashioka | 403/171 |
| 3,960,275 | A | * | 6/1976 | Haughton et al. | 211/182 |
| 4,105,348 | A | * | 8/1978 | Anderson et al. | 403/172 |
| 4,270,872 | A | * | 6/1981 | Kiyosawa | 403/170 |
| 4,290,532 | A | * | 9/1981 | Reynolds | 211/200 |
| 4,297,795 | A | * | 11/1981 | Licari | 34/239 |
| 4,308,802 | A | * | 1/1982 | Munz | 108/156 |
| 4,358,214 | A | * | 11/1982 | Shull | 403/234 |
| 4,435,031 | A | * | 3/1984 | Black et al. | 439/82 |
| 4,556,337 | A | * | 12/1985 | Marshall | 403/255 |
| 4,828,123 | A | * | 5/1989 | Basore | 211/202 |
| 4,954,032 | A | * | 9/1990 | Morales | 411/289 |
| 5,135,341 | A | * | 8/1992 | Leyder | 411/182 |
| 5,149,149 | A | * | 9/1992 | Wu | 285/402 |

(Continued)

*Primary Examiner* — Sarah Purol
(74) *Attorney, Agent, or Firm* — Stetina Brunda Garred & Brucker; Lowell Anderson

(57) ABSTRACT

A laundry rack is provides having a plurality of scissor linkages formed by pairs of inner and outer legs with each leg having an upper and lower end, with each pair of legs having aligned bores through which each pair of legs are rotationally connected. Each scissor linkage having aligned bores through which cross-members can be connected to join two scissor linkages to form at least a first end frame having at least an upper and lower linkage, and at least two scissor linkages being joinable to form a second end frame having at least an upper and lower linkage. Each end frame having respective first and second elongated latch members. The latch member each having first and second opposing ends that are laterally offset from each other. The first end being rotatably connected to an upper end of the inner leg on the upper scissor linkage and located on an outer side of that upper end. The second end being placed adjacent an inner side of the upper end of the outer leg in the same scissor linkage as the first end during use. The second end of each latch member adapted to releasably connect to a cross member during use.

31 Claims, 5 Drawing Sheets

U.S. PATENT DOCUMENTS 5,320,443 A * 6/1994 Lien et al. ..... 403/154
5,393,162 A * 2/1995 Nissen ..... 403/154
5,405,828 A * 4/1995 Bunji et al. ..... 504/246
5,600,870 A * 2/1997 Fields et al. ..... 16/342
5,651,652 A * 7/1997 Williams et al. ..... 411/508
5,772,355 A * 6/1998 Ross et al. ..... 403/322.1
5,888,012 A * 3/1999 Nygren et al. ..... 403/13
6,118,073 A * 9/2000 Lau et al. ..... 174/66
6,155,741 A * 12/2000 Took ..... 403/260
6,238,127 B1 * 5/2001 Jhumra et al. ..... 403/282
6,279,754 B1 * 8/2001 Hoss et al. ..... 211/26
6,394,292 B1 * 5/2002 Sabounjian ..... 211/202
6,427,858 B2 * 8/2002 Sabounjian ..... 211/202
6,932,227 B1 * 8/2005 Glenn ..... 211/202
7,156,356 B2 1/2007 Blattner
7,172,081 B2 * 2/2007 Trowsdale ..... 211/202
7,519,056 B2 * 4/2009 Ishwar et al. ..... 370/389
7,597,205 B2 * 10/2009 Shepard-Vagedes et al. 211/200
7,631,848 B2 * 12/2009 Enochs ..... 248/327
8,042,698 B2 * 10/2011 Kim et al. ..... 211/78
8,057,120 B2 * 11/2011 Wernlund et al. ..... 403/187
8,096,430 B2 * 1/2012 Lim ..... 211/195

* cited by examiner 22
71
50
24
72
70

22
70
30
24
71
74
72

22
70
50
26
71
50
78
76
30

26
22
30

α
24b
22
32
26
56
56
44
52
22
40
26
48
α
32
26
42
40
28b

LAUNDRY RACK

BACKGROUND

The present invention relates generally to laundry drying racks, and more particularly to a laundry drying rack having collapsible, scissor legs.

Conventional laundry drying racks are used to dry laundered items. Laundry drying racks have particular application when the laundered items are too delicate to be placed in an electric dryer or may shrink in the dryer's heat. Laundry drying racks may also be used for temporary storage such as during folding or ironing tasks.

In order to minimize the costs of such laundry drying racks to end consumers, it is desirable that the laundry drying racks be shipped and packaged in a disassembled state. Such disassembly allows for the components of such laundry drying rack to be compactly packaged thereby lowering shipping costs. Further avoidance of assembly by the manufacturer avoids the associated assembly costs, the saving of which may be passed along to the consumer. Conventional laundry drying racks, however, frequently comprise numerous components which makes assembly difficult and time consuming. Further, the scissor legs require the use of different lengths on the drying rods and this complicates manufacture, confuses persons assembling the dryer racks, and increases costs.

Accordingly, there is a need in the art for an improved laundry drying rack which is structurally stable, easy to assemble, and less expensive to manufacture.

More specifically, a prior art drying rack is shown in FIGS. 1A and 1B. It has two end frames 20 made of a plurality of inner members or inner legs 22 with upper and lower ends 24*a*, 24*b*, respectively, and outer member or outer legs 26 with upper and lower ends 28*a*, 28*b*, respectively. The inner and outer legs 24, 28 are rotatably joined at joint 30 which is at or near the center of the legs where they cross each other. Various types of connectors can be used to form rotation joint 30, with a tubular sheath being preferred. The rotatably joined legs 22, 26 are also referred to as scissor linkages. The pivotally joined legs 22, 26 form a generally X-shaped frame assembly that rotates about an axis perpendicular to the lengths of the legs 22, 26, through the joint 30. Two or three such X-shaped assemblies are stacked on top of each other, with the upper end 24*a* of an inner leg 22 on a lower frame being rotatably joined to the lower end 26*b* of an outer leg 26 on the next highest frame, and the upper end 28*a* of an outer leg 26 being rotatably joined to the lower end 24*b* of an inner leg 22 on the next highest frame. More specifically, each leg 22, 26 has an inner side 22*i*, 26*i* facing toward the opposing end frame and an outer side 22*o*, 26*o* facing away from the opposing end frame.

When these various frames are joined to achieve the desired height of the dryer rack, the end frames form scissor type connectors with all of the inner legs 22 parallel and inclined one direction and all of the outer legs 26 parallel and inclined in an opposite direction. The same construction applies to both of the end frames 20.

Cross members 32, typically cylindrical rods, join the end frames 20, typically at each rotatable joint in the ends 24, 28, and optionally at the middle joint 30. Items of clothing are hung on the cross-members 32. Fasteners 33 connect the cross members 32 to one or both of the ends 24, 28.

The top frame has ends 24*a*, 28*a* extending upward. To stabilize the frame, these ends 24*a*, 28*a* are typically connected by a connecting member or latching member 34 extending between and connecting distal ends 24*a*, 28*a* on the top of each end frame 20.

Because the end frames 20 are formed by crossing the legs 22, 26, the ends 24*a*, 28*a* are offset by the thickness of one of the legs 22, 26. The side of an end frame 20 or of leg 22, 26 facing the other end frame 20 will be referred to as the inner side, and the other side will be referred to as the outer side. The inner leg 22 remains on the inner side of the end frame 20 and the outer leg 26 remains on the outer side of the end frame 20. Thus, the corresponding inner legs 22 on opposing end frames 20 are closer together than the corresponding outer legs 26 on the opposing end frames 20. The cross members 32 connecting distal ends 24*a*, 28*a* on opposing end frames 20 are thus of different lengths, often varying by the twice the thickness of legs 22, 24. A longer cross member 32 is needed to connect outer distal ends 28*a* than to connect inner distal ends 24*a*.

A latching member 34 located on the inside end 24*a* of inner leg 22 is offset inward of the distal end 28*a* of outer leg 26 by the thickness of the inner leg 22. A latching member 34 located on the inside end 28*a* of outer leg 26 offset outward of the distal end 26*aa* of inner leg 22 by the thickness of the outer leg 26. A latching member 34 extending from the inner side of distal end 24*a* of inner leg 22 will hit the cross member 32 fastened to the distal end 28*a*. But the cross members 32 do not typically extend much past the surface of outer legs 22. Prior art latch members 34 have thus been located on the inside of both end frames 20, requiring the latch members to be angled to do so since the legs 22, 26 are offset. In other words, cross member 34 has one end rotatably connected to the inside of upper end 24*a* and connected to the inside of upper end 28*a*, and because the ends 24*a*, 28*a* are offset, the cross member 34 is angled. Often, one end of the cross-member 34 is rotatably connected to the upper end of a leg 22, 26 while the other end is releasably connected as by a hook or latch.

Usually, cross members or rods 32 are placed at several locations along the length of the latch member 34 to allow for flexibility in the number of garments supported and a variety in the manner of supporting garments for drying. Some or all of the cross-members 32 on the latching member 34 are shorter than the other cross-members 34. If the latching member 34 is fastened to the inner side of outer leg 26 then the latching member 34 is angled so it connects inside of the inner leg 22, resulting in the latching member 34 being angled and requiring each of the cross-members 32 held by the latching member 34 to be a different length. Moreover, angling the orientation of latching member 34 either binds the rotation of the cross members 32 passing through the distal ends 28 or requires drilling holes through the latching member 34, both of which are costly, cumbersome, and complicate manufacturing and assembly.

The different lengths of the cross-members 32 complicates manufacturing and shipping, confuses those assembling the dryer racks, and costs more to produce a variety of different parts and put the correct number of each part in the packages. There is thus a need for a foldable dryer rack having a collapsible end frame or frames that use rods of the same length. There is a further need for a latch member that is not inclined so as to twist the end frame(s).

BRIEF SUMMARY

A laundry stand is provided having two opposing end frames, with each end frame having a plurality of scissor linkages and with each linkage having an inner and an outer leg rotatably joined to expand for use and fold together to reduce space. A plurality of cross members extend between and fasten to each of the opposing end frames. The top of the laundry stand is provided with a latch member on each end frame, with cross-members extending between the latch members. Each latch member has a first latch end on the outer side of the distal end of the inner leg of its end frame, and rotatably connected to that leg. Each latch member has a second latch end on the inner side of the distal end of the outer leg of the same end frame, and is configured to releasably fasten to a cross member. The first and second ends of the latch member each extend along straight lines that are parallel but offset from each other in the plane of the outer legs, so that the cross members can all be the same length and may extend between the planes of the outer legs on each end frame. The use of equal length rods or cross members provides advantages in packaging, cost reduction and ease of assembly.

In more detail, there is thus advantageously provided a collapsible laundry rack having a first end frame with an inner and outer leg rotationally joined to fold generally parallel to each other in a collapsed configuration and to form an X shape in an expanded configuration, with each leg having an upper end and a lower end. The laundry rack has a second, similarly constructed end frame with an inner and outer leg rotationally joined to fold generally parallel to each other in a collapsed configuration and to form an X shape in an expanded configuration, and with each leg having an upper end and a lower end. The first and second end frames are generally parallel with the inner legs closer together than the outer legs and the outer legs being farther apart than the inner legs. Each leg has an inner side facing toward the opposing end frame and an outer side facing away from the opposing end frame.

The laundry stand has a first latch member with a first end on the outer side of the distal end of the inner leg of the first frame and a second end on the inner side of the distal end of the outer leg. The first and second ends of the first latch member each extend along straight lines that are parallel but offset from each other. There is also a second latch member having a first end on the outer side of the distal end of the inner leg of the first frame and having a second end on the inner side of the distal end of the outer leg. The first and second ends of the first latch member each extend along straight lines that are parallel but offset from each other.

The laundry stand also has a plurality of rods each having the same length and joining the first and second end frames at least adjacent the distal ends of some of the legs of each end frame and joining the first and second latch members.

The laundry stand optionally has the first end of each latch member rotatably fastened to the inner leg of the end frame. Further, the second end of each latch member is preferably releasably fastened to one of the rods which extend between the distal ends of the outer legs of the first and second end frames. A retaining mechanism can be provided to maintain the releasable connection in place until manually released. The rods preferably extend through the distal ends of the first and second legs of each end frame, but optionally may not extend through the distal ends of the outer legs of each end frame.

The laundry stand may have each latch member formed from a first elongated member having a thickness of an inner leg and a second elongated member having a thickness of an outer leg. Further, the first and second elongated members can be joined together along an overlapping portion adjacent the second end, with the first and second elongated members being parallel to each other.

Advantageously the laundry stand has a plurality of joined scissor linkages or X linkages. Thus, there may be third and fourth end frames constructed like the first and second end frames, with the second and third end frames each having an upper distal end of an inner leg rotatably joined to a lower distal end of an outer leg of one of the first and second end frames, and further having an upper distal end of an outer leg rotatably joined to a lower distal end of an inner leg of one of the first and second end frames. There is thus provided a laundry stand with a plurality of first and second end frames each having a an upper distal end of an inner leg rotatably joined to a lower distal end of an outer leg and further having an upper distal end of an outer leg rotatably joined to a lower distal end of an inner leg.

In the preferred embodiment the first end of each latch member is rotatably fastened to the upper distal end of the inner leg and the second end of each latch member is releasably fastened to a rod extending between the distal ends of the outer legs of the first and second end frames. The outer legs and first end of the latch members of each end frame are preferably in substantially the same (first) plane and the inner legs and second end of the latch members are in substantially the same (second) plane adjacent to but offset from the first plane. The rods may connect to the end frames and latch members using various mechanisms, including connecting through connectors configured to fasten to an end of the rod and connect the rod to one of the end frames.

There is also provide a kit for a collapsible laundry stand. This includes the above parts in an unassembled configuration. The kit may include a plurality of pairs of inner and outer legs with each leg having an upper and lower end, each pair of legs having aligned bores through which each pair of legs are rotationally connected to form a plurality of scissor linkages. At least one end of each of the legs has corresponding bores through which cross-members can be connected to join two scissor linkages to form a first end frame having at least an upper and lower linkage. At least two scissor linkages are joinable to form a second end frame having at least an upper and lower linkage.

The kit further has a plurality of cross-members of the same length and having opposing distal ends. If the cross-members do not directly fasten to the scissor linkages, there may be a plurality of connectors configured to fasten one of the distal ends of each rod to one of the legs. The end frames each have respective first and second elongated latch members. Each latch member has first and second opposing ends that are laterally offset from each other. The first latch end is rotatably connected to an upper end of the inner leg on the upper scissor linkage and located on an outer side of that upper end. The second latch end is placed adjacent an inner side of the upper end of the outer leg in the same scissor linkage as the first end during use. The second end of each latch member is adapted to connect to a cross member during use, with a hook, notch or clip being preferred. Each latch member has a plurality of aligned bores sized to connect to the cross members during use.

In further variations, the kit may have the cross-members directly fastened to the end frames, or a plurality of connectors can be used in which the connectors have a first connector end configured to fasten to an end of a cross-member and a second connector end configured to fasten to a leg or latch member. The offset latch member allows the cross members extending between the latch members to have the same length as the other cross members in the kit. The kit can contain the other structural variations discussed above, and discussed in more detail hereinafter.

There is also provided a method for stabilizing a laundry stand having two opposing end frames comprising a plurality of scissor linkages with each linkage having an inner and an outer leg rotatably joined to expand for use and fold together to reduce space, with a plurality of cross members each extending between and fastened to each of the opposing end frames, the method includes the steps of providing one end frame with a first latch member having a first end extending along a first axis and an opposing second end extending along a second axis parallel to but offset from the first axis. The method further includes rotatably connecting the first end to an upper end of an inner leg and configuring the second end to be connected to a cross-member at the upper end of the outer leg on the same scissor linkage during use of the laundry stand. The method also includes providing the other end frame with a second latch member having a first end extending along a third axis and an opposing second end extending along a fourth axis parallel to but offset from the third axis. The method additionally includes rotatably connecting the first end of the second latch member to an upper end of an inner leg of the other end frame. Further, the second end of the second latch member is configured to be connected to a cross-member at the upper end of the outer leg on the same scissor linkage of the other end frame during use of the laundry stand. Finally, the method includes forming a plurality of aligned bores in the latch members to fasten to the cross-members during use of the laundry stand.

The method advantageously, but optionally may also include providing a plurality of end connectors having a first end configured to fasten to an end of the cross-members and having a second opposing end configured to fasten to one of the legs or latch members. The method may further include forming all of the cross members that connect to the end frames and latch members to have the same length. Moreover, the method may include folding the end frames together with the outer legs abutting another outer leg and one outer leg abutting the first end of one of the latch members, and with the inner legs abutting another inner leg and one inner leg abutting the second end of the latch member.

There is thus provided a laundry stand that allows the use of cross members having the same length, resulting in reduction of costs, smaller packaging, reduced shipping costs, and a compact storage and shipping configuration.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 2B:
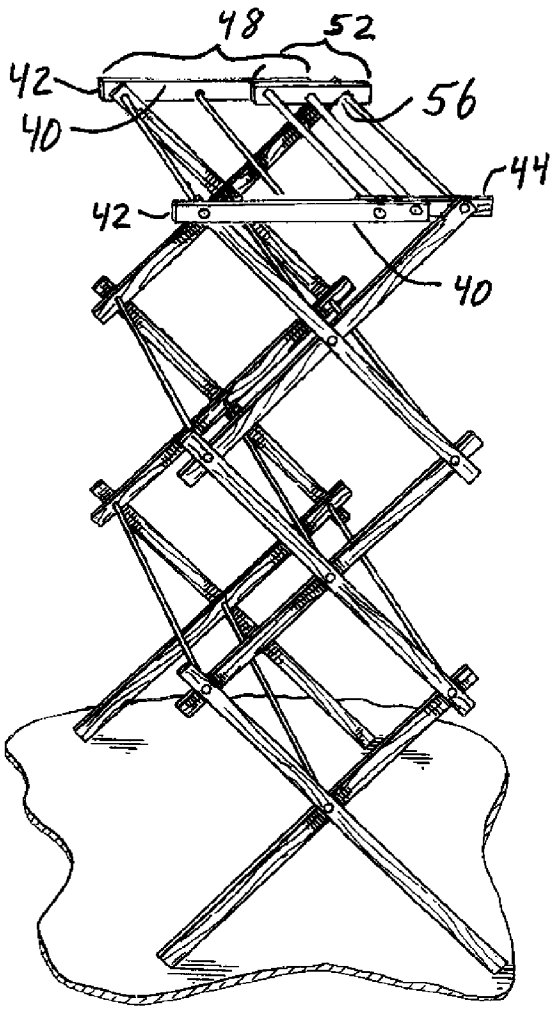
FIG. 2B is a perspective view of a laundry stand with offset latch members.
Figure 2A:
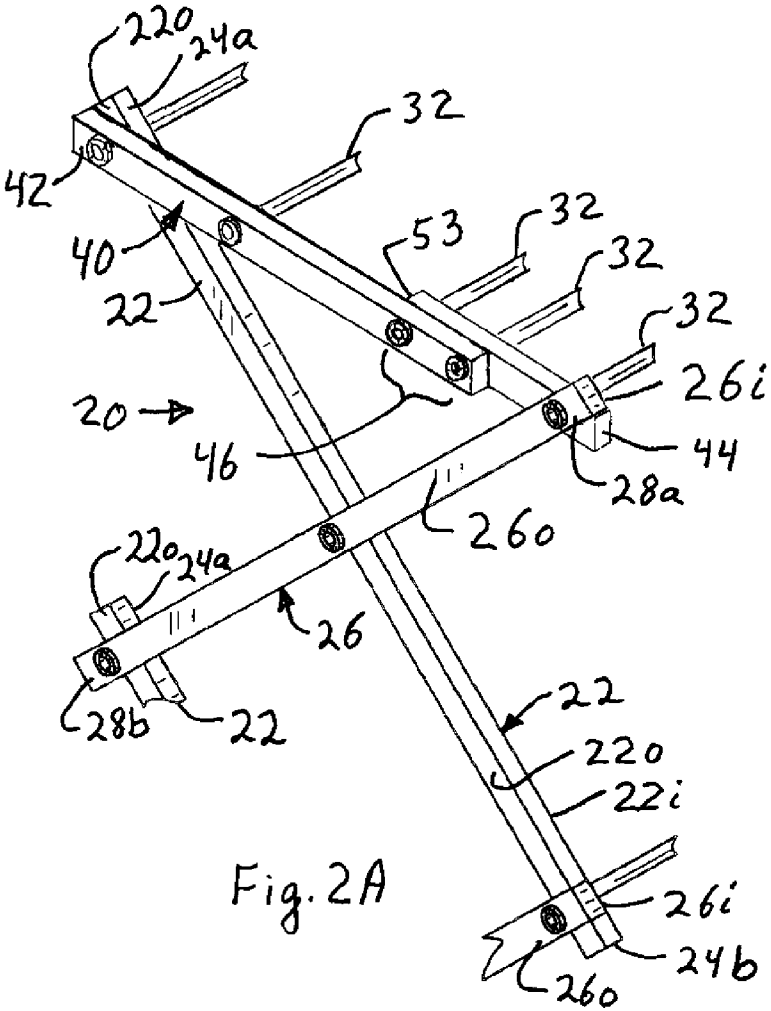
FIG. 2A is a partial perspective view of the top portion a laundry stand of FIG. 2B, with an offset latch member.
Figure 3:
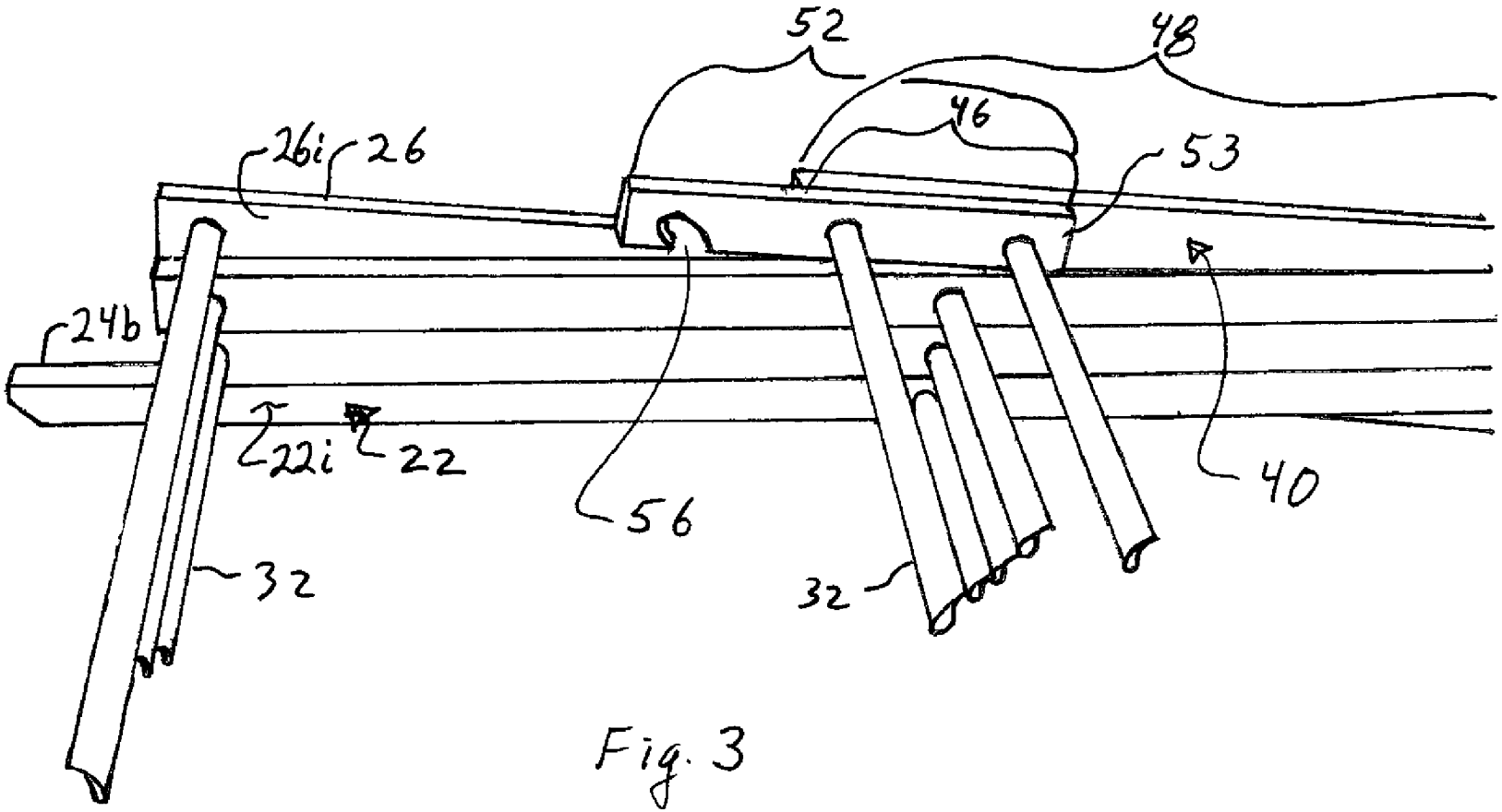
FIG. 3 is a partial perspective view showing an end frame of the laundry stand of FIG. 2B in a collapsed or folded configuration.
Figures 4, 5A, 5B, 6, 7:
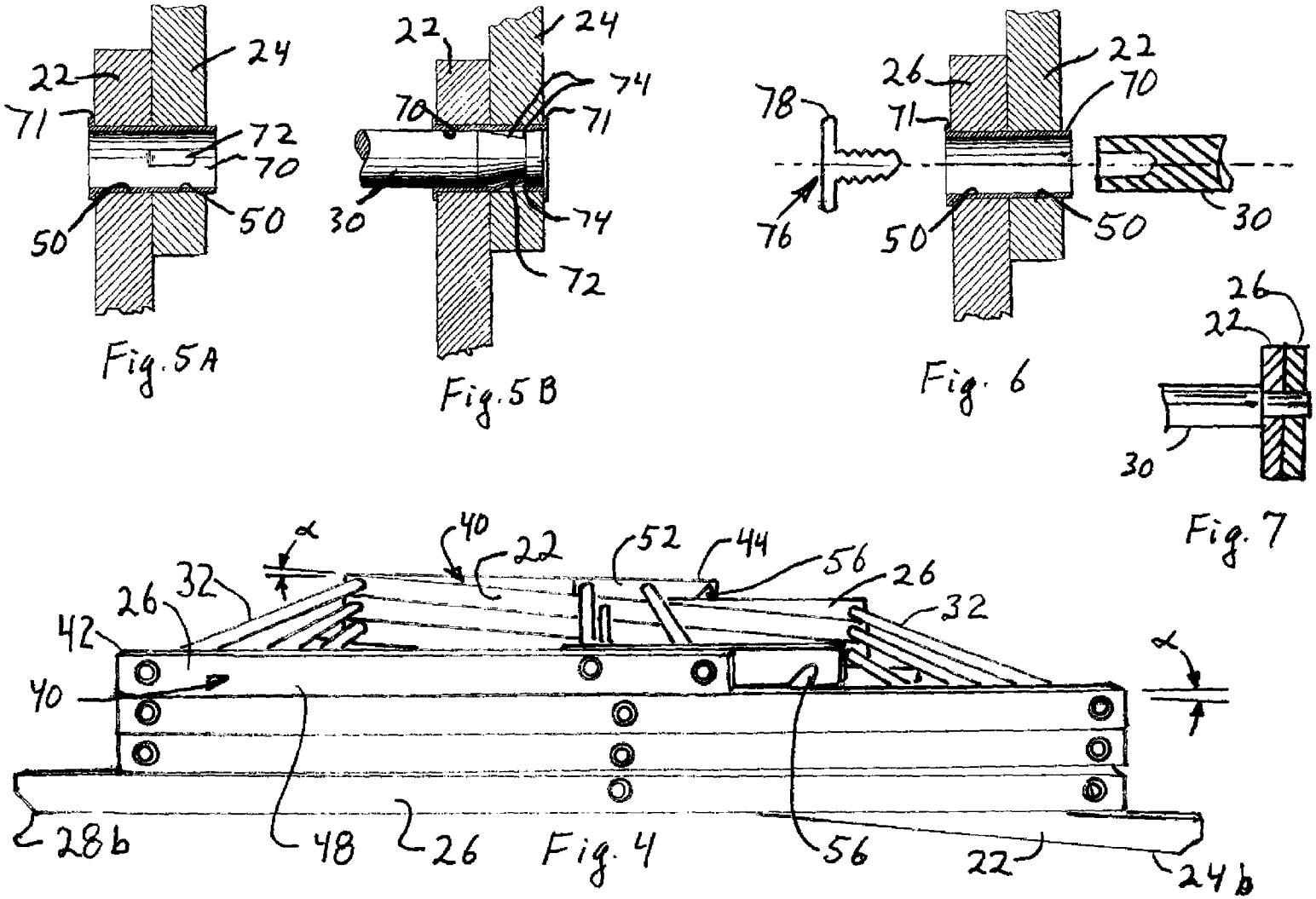
FIG. 4 is a perspective view showing the laundry stand of FIG. 2B in a collapsed or folded configuration.
FIG. 5A is a sectional view showing a sheath joining two legs.
FIG. 5B is a sectional view showing the end of a cross member or rod in the sheath of FIG. 5A.
FIG. 6 is an exploded sectional view showing a threaded fastener connecting an end of a cross member to legs of a laundry stand.
FIG. 7 is a sectional view of a connection of a cross member to the legs of a laundry stand.

Referring to FIGS. 2-4, an end frame 20 is provided which has at least two pairs of inner and outer legs 22, 26 opposing each other and joined by at least one rod 32. The basic construction of the end frame(s) 20 is as in the prior art and is not repeated herein.

Figure 1B:
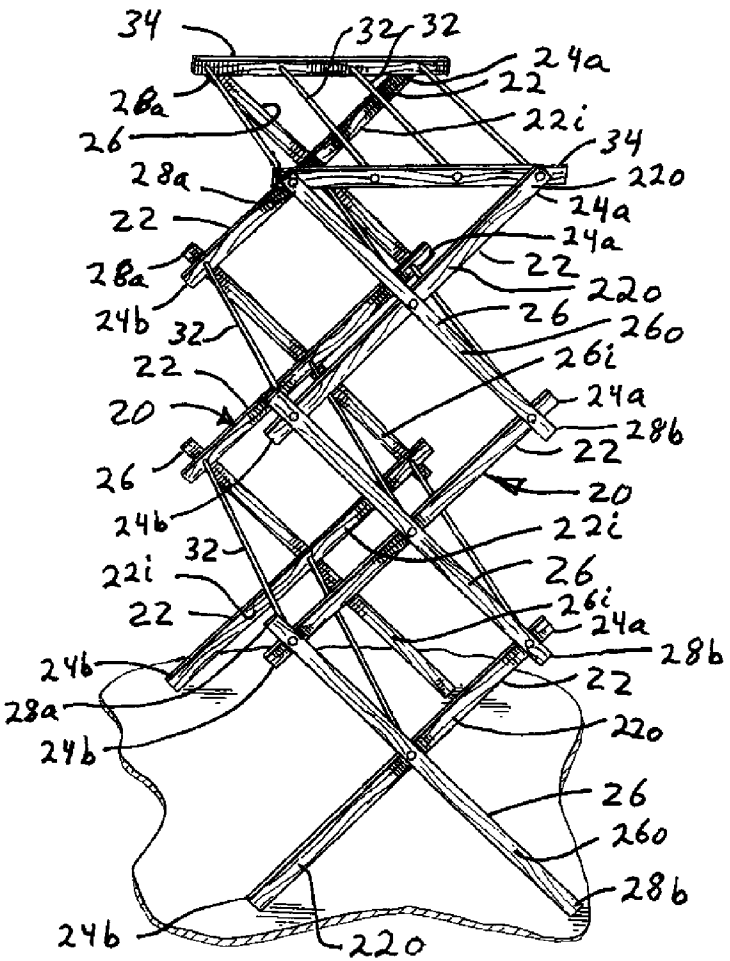
FIG. 1B is a perspective view of a prior art laundry stand.
Figure 1A:
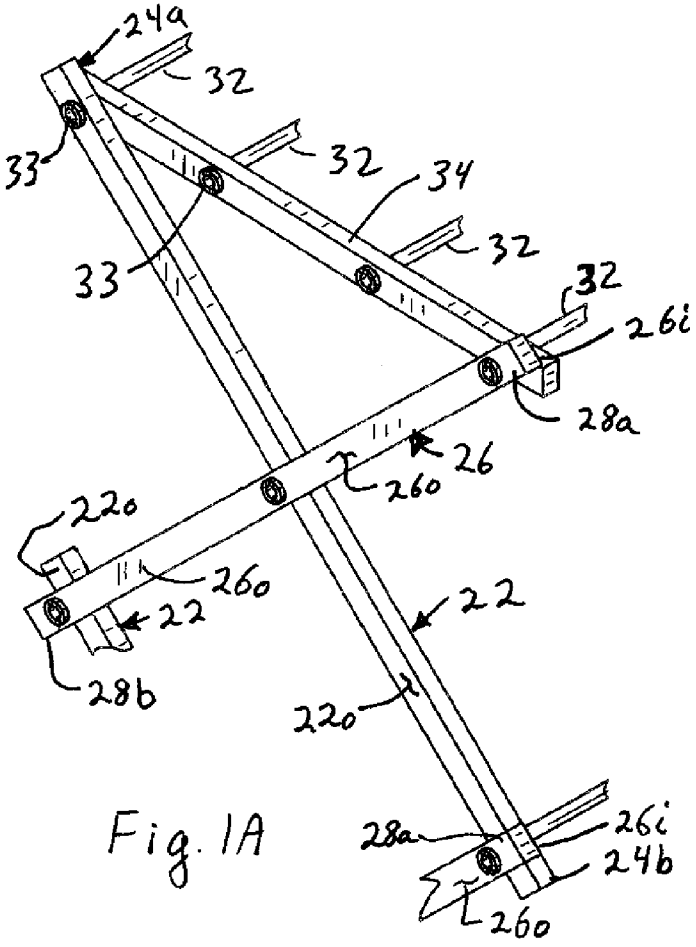
FIG. 1A is a partial perspective view of the top portion of a prior art laundry stand shown in FIG. 1B.

A latching member 40 is provided that extends from the outer side 22*o* of upper end 24*a* of inner leg 22 to the inner side 26*i* of the upper end 28*a* of outer leg 26. The latching member 40 is on the opposite side of the at least one of the legs 22, 26 than is normal. The latching member 40 has a first end 42 adjacent the outer side 22*o* of upper end 24*a* of inner leg 22 and is generally parallel to the adjacent face of end 24*a*. In the prior art the latch member (latch 34 FIG. 1A) is normally angled, not parallel.

The latching member 40 has a second end 44 that is on the inner side 26*i* of and generally parallel to upper end 28*a* of outer leg 26. An offset 46 is located between ends 42, 44 and preferably but optionally has a length sufficient to allow a plurality of cross-members 32 to pass through aligned bores or holes 50 (FIGS. 5-7) in the latch member 40. The holes 50 in the ends 42, 44 are located to align with the holes 50 through the legs 22, 26 through which the rods 32 join the end frames 20.

There is thus advantageously provided a latching member 40 having a first end adjacent the inner side of distal end 24*a* of outer leg 22 and rotatably joined thereto. Typically, a shaft passes through the abutting or adjacent parts of the latch 40 and leg 22 with the latch and leg rotating about the shaft as discussed later regarding FIGS. 5-7. The latch member 40 uses the second end 44 to connect to the other leg forming the immediate end frame or to connect to something affixed thereto, such as cross-member or rod 32. A plurality of rods 32 extend between the latch members 40 on opposing end frames 20.

An offset 64 is located between the ends 42, 44 and laterally shifts the locations of ends 42, 44 so they do not extend along the same straight line or in the same plane, but instead extend along lines that are offset from and parallel to each other. The latching member 40 is optionally, but preferably configured so that the rods 32 extending between opposing latch members 40 on opposing end frames 20 have the same length as other rods 32 on other end frames.

The latch member 40 may be formed by a first portion 48 (FIG. 2B) having a thickness about the same as the thickness of outer leg 26, and a second portion 52 (FIG. 2B) having a thickness of the inner leg 22, with the first and second portions 48, 52 overlapping along an overlapping portion forming the offset 46. The first portion 48 is rotatably connected to the outer side 22*o* of inner leg 22 and in the general plane of the outer legs 26, while the second portion 52 is connected adjacent the inner side 26*i* of outer leg 26 and is in the general plane of the inner legs 22. Advantageously, the second end 44 has a notch 56 (FIGS. 2B & 3) that hooks over the rod 32. By making the first and second portions 48, 52 the same thickness as the outer and inner legs, respectively, the portions 48, 52 can align and abut along the overlapping portion and form offset 46.

The first and second portions 48, 52 can be fastened together by various means, including adhesives, nails, screws, brads etc., if the portions 48, 52 are separate parts joined to form latch member 40. Alternatively, the latch member 40 can be formed from a single piece of material as by cutting, bending, casting or molding. In the depicted embodiment, the first and second portions are made of wood or plastic joined along an extended overlapping portion forming offset 46. When so constructed, it is preferably, but optional, to have more than one rod 32 extends through the overlapping portion 46 of the first and second portions 48, 52 since the rods 32 can help connect the portions 48, 52. In the depicted embodiment, two rods 32 extend between opposing latch members 40 and through both first and second portions 48, 52 at the overlapping portions forming the offset 46. This may result in unequal spacing of the rods 32 extending between the opposing latch members 40, with the rods 32 in the overlap portion 46 being closer together.

If the first portion 48 extends too close to the outer leg 26, then the end of the first portion 48 will hit the inclined outer leg 26 so that the second end 44 cannot engage the rod 32 so that the rods extending between opposing latch members 40 form a flat and preferably horizontal plane. The outer portion 48 of latch 40 thus advantageously ends before abutting outer leg 26 when the laundry stand is in use. It is possible for the end of the first portion 48 to be located so that it abuts the edge of leg 26 at upper end 28*a* in order to further limit rotation of the latching member 40. Such an abutting end on first portion 48 could be angled to have the same angle as leg 26 during use.

Referring to FIGS. 3-4, the end frames 20 can be collapsed into a compact configuration when not in use or for shipping. The collapsed configuration of each end frame 20 is achieved by rotating legs 22, 26 about the rotating joint at or near the center of the legs so that the legs are parallel to each other. Typically, the lowest frame 20 has slightly longer bottom legs so that the bottom ends 24*b*, 28*b* on the lowest frame 20 is further from the pivoting center connection. Then the end frames are collapsed, these longer legs stick out beyond the other ends of the folded legs. While not rotatably joined at the middle, the legs on these bottom frames are joined at "about" the middle for purposes of this description. Because the legs on multiple end frames 20 are joined at the middle to adjacent legs of the next end frame 20, the legs stack or fold together along an inclined line to the horizontal with the inner legs inclined by an angle alpha ($\alpha$) (FIG. 4) in one direction and the outer legs inclined by an alpha ($\alpha$) in the opposite direction.

Because the second portion 52 is offset inward toward the opposing end-frame, and because it is aligned with but offset from an axis along the length of the first portion 48 or latch 40, the second portion 52 will abut the adjacent inner leg 22. Specifically, the inner end 53 will abut the edge of adjacent inner leg 22. This abutment can cause the latch member to misalign with the other outer legs 26 in the completely collapsed configuration. In short, the latch member 40 will stick up away from the stacked legs. This abutment and resulting misalignment can be reduced or avoided by placing the offset 46 close to the end 44, or by reducing the length of the overlap portion 46 or reducing the length of second portion 52. Further, placing an incline on the edge of the second portion 52 selected to correspond to the inclination of the abutting edge of leg 22 in the collapsed configuration, could also reduce the misalignment and amount by which the end 44 of latch 40 sticks up. Having the end 44 protrude or stick up increases the collapsed height of the collapsed laundry stand and can affect packaging, so little or no misalignment is preferred.

Advantageously, the cross members or rods 32 extend only between the first portion 48 and overlapping portion forming offset 46 so the rods have the same length as the other cross members 32. Again, because the first portion 48 is in the plane of the outer legs 22, the same length of rods 32 can be used to extend between the legs 22 and the first portion 48 of latch 40. Since the rods 32 extend to the plane of the outer legs 26. The cross member or rod 32 fastening to the second portion 52 may also have the same length as the other cross members 32 since the rod 32 passes through the second end 44 of latch member 40, and into the end 28*a* of outer leg 26—so that all cross members 32 have the same length. In short, the outer legs 26 and first portions 48 of latches 40 are in common planes on each opposing end frame, and those planes are spaced a uniform distance apart. Thus, the cross members or rods 32 fasten to parts in those planes can The length of the cross members 32 will vary with the type of connection used to fasten the cross members 32 to the legs 22, 26 and to the latching members 40. Advantageously, the same connection mechanism is used for all. Referring to FIGS. 5-7, various illustrative connections are shown, but other known connections or those developed in the future could be used.

FIGS. 5A-5B show legs 22, 24 with aligned holes 50 through which a cylindrical tubular sheath 70 extends. An enlarged end portion or lip 71 on the sheath prevents it from being pushed through the holes 50 in legs 22, 26. The sheath 70 the optionally has a slot in an end opposite the lip 71 to allow that end to resiliently deflect inwardly to allow the sheath to pass through the bore or hole 50 in leg 22, 26. The sheath defining a central bore along which the distal ends of cross members or rods 32 pass to fasten to the legs 22, 26 of the end frames 20. A portion of the sheath wall is cut out and extended inward to form projection 72 that advantageously is aligned to extend along a length of the sheath so that a free distal end of the projection is closer to an end of the sheath than is the connection of the projection with the sheath. The end of the connecting member or rod 32 has a recess or ledge 74 that engages the projection 72 to prevent removal. A tapered portion ending in a cylindrical disc is shown as forming the recess or ledge 74. The recess or ledge can be formed directly in the rod 32, or it can be on a separate part, such as a molded plastic part, fastened to the end of the rod 32, preferably with a cylindrical recess to receive the end of the rod. In use, the sheath allows the legs to rotate while fastening the rod 32 to the sheath and legs. A similar construction is found in U.S. Pat. No. 5,133,470, the complete contents of which are incorporated herein by reference.

Referring to FIG. 6, a similar connection is shown having sheath 70 with an end of rod 32 inserted in the sheath and a threaded fastener 76 having a head 78 larger than hole 50 screwed into the end of the rod 32 to prevent the rod from being removed. The sheath 70 can be omitted, but is preferred since it helps define a predictable diameter opening for the ends of rod 32.

FIG. 7 shows a rod 30 having a distal end with a smaller diameter sized to pass through holes 50 in legs 22, 26. The smaller diameter end can be nailed or staked to the outer leg 26.

The cross member 32 and latching member 40 may be fastened together by various mechanisms, including a rotating hook or latch. A latch member using open notch 56 engaging a rod 30 is shown in the figures. A spring clip (not shown) can be optionally placed over the notch 56 to retain the rod 30 in the notch 56.

The cross members 32 could be coupled to the legs 22, 26 and latching member 40 by various other ways, including, but not limited to connectors 80. Various suitable connectors are described in U.S. Pat. Nos. 6,932,227, 6,394,292, 4,297,795, or 2,393,606, or U.S. patent application Ser. Nos. 11,716,856, 10,924,320, 10,664,580, with the complete contents of each of the patents and patent applications being incorporated herein by reference. But various other coupling mechanisms previously known or developed in the future could be used with the new latching member 40.

Figure 8A:
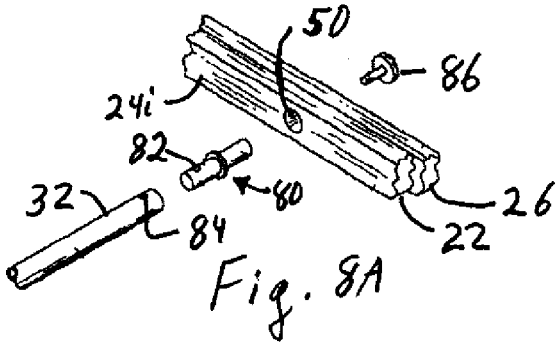
FIGS. 8A and 8B are exploded perspective views showing a connector fastening a cross member to the legs of a laundry stand and to a latching member, respectively.
Figure 8B:
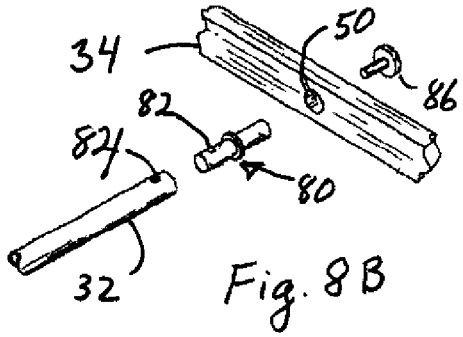

FIGS. 8-10 show illustrative connectors 80. FIGS. 8A and 8B show a connector 80 of the type described in U.S. Pat. No. 6,394,292 in which the connector has first end with a projection 82 located to engage a recess 84 in the end of a tubular cross member 32. The connector 80 has a second end with a recess adapted to receive a fastener 86 to prevent the connector from being pulled away from the leg 22, 26 or latch member 50. The fastener 86 can be a threaded fastener 76.

Figure 9A:
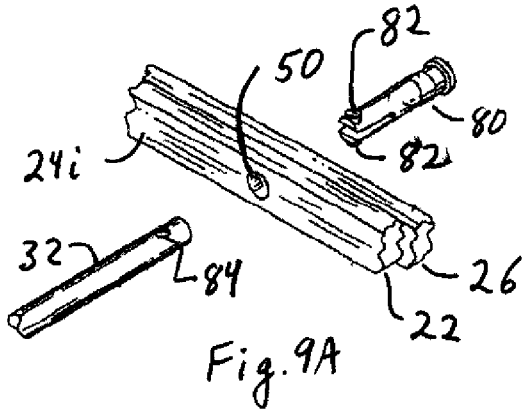
FIGS. 9A and 9B are exploded perspective views showing a connector fastening a cross member to the legs of a laundry stand and to a latching member, respectively.
Figure 9B:
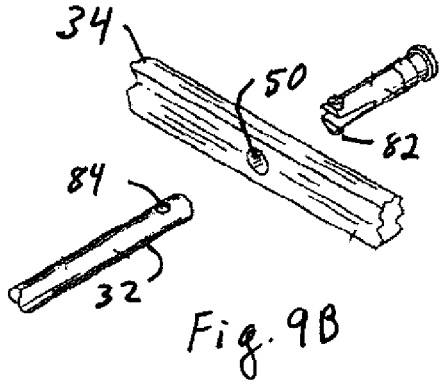

FIGS. 9A and 9B show a connector 80 described in U.S. Pat. No. 6,394,292 in which the connector has an enlarged head that resists passage through hole 30, but has a split shank with projections 82 that are resiliently urged outward and that can pass through hole 50 to engage a recess 84 in the wall of tubular cross member 32.

Figure 10A:
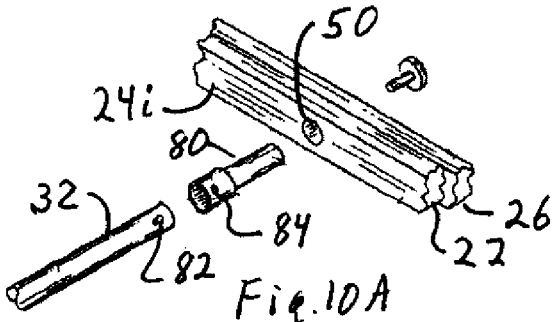
FIGS. 10A and 10B are exploded perspective views showing a connector fastening a cross member to the legs of a laundry stand and to a latching member, respectively.
Figure 10B:
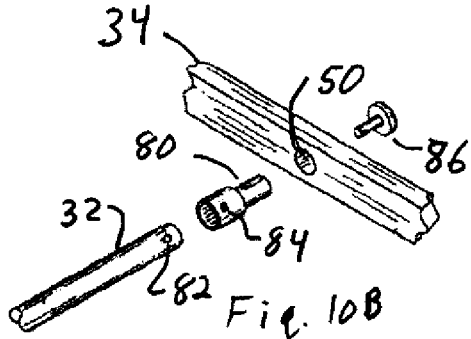

FIGS. 10A and 10B show a connector 80 having a recess in a first end to receive a distal end of the cross-member 32. A projection 82 is on the cross member and engages a recess in the first end of the connector 80. A second end of the connector 80 passes through the legs 22, 26 or latch member 34 to engage fastener 86. The fastener 86 can be a threaded fastener 76.

The end frames 20 and typically made of wood or plastic, with the rods or cross members 32 are typically made of wood or plastic, or sometimes made of wood coated with plastic other sealant to prevent wood splinters from abrading or getting caught in fabric placed on the members 32. The latching member 40 is preferably made of wood having two pieces of wood with the same thickness as legs 22, 26 joined together by adhesives or various types of fasteners such as nails, screws, brads or external bands. Alternatively, the latching member 40 could be molded of a single, unitary piece of plastic of suitable thickness. Alternatively, the latching member 40 could be made of metal bent with an offset.

It is believed suitable to have the rods 30 fastened to the end frames 20 using legs 22, 26 in ways requiring manual release of the connection, but only where the legs 22, 26 cross, with the remaining rods 30 being inserted into the mating and aligned holes in the legs but held only by closely fitting parts between the holes in the end frames 20 and the ends of the rods 30. Thus, connectors 80, including fasteners 76, could be used only at the locations where legs 22, 26 cross. This allows fewer parts to be used to form the dryer rack, with the connectors 80 maintaining the spacing between the end frames 20 so the remaining rods 30 do not readily fall out of the dryer rack.

Further, a slight taper on the distal ends of the rods 30 to form a slight incline toward the distal end, combined with a slight taper in the mating holes in end frame 20, allow the ends of the rods 30 to fit into the holes but not pass through them. The taper on the rods 30 results in the distal ends of the rods 30 being slightly smaller in diameter than the remainder of the rods. The holes in the end frames 20 have a maximum diameter on the side of the end frame 20 facing the adjacent ends of the rods 30 that fit into the holes, while the holes have a smaller diameter on the other side of the end frames 20 so the rod cannot pass completely through the end frame. A slight taper of a few degrees, less than 10 degrees and preferably less than 5 degrees is believed suitable, with the holes and rods 30 having mating configurations with the same taper. Alternatively, the ends of rods 30 can be cylindrical to mate with cylindrical holes of slightly larger diameter.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A collapsible laundry rack, comprising:

a first end frame having an inner and outer leg rotationally joined to fold generally parallel to each other in a collapsed configuration and to form an X shape in an expanded configuration, each leg having an upper end and a lower end;

a second end frame having an inner and outer leg rotationally joined to fold generally parallel to each other in a collapsed configuration and to form an X shape in an expanded configuration, each leg having an upper end and a lower end, the first and second end frames being generally parallel with the inner legs closer together than the outer legs and the outer legs being farther apart than the inner legs, each leg having an inner side facing toward the opposing end frame and an outer side facing away from the opposing end frame;

a first latch member having a first end on the outer side of the distal end of the inner leg of the first frame and having a second end on the inner side of the distal end of the outer leg with the first and second ends of the first latch member each extending along straight lines that are parallel but offset from each other, the first end of the latch member being rotatably fastened to the inner leg of the end frame and the second end of the latch member being releasably fastened to a rod a second latch member having a first end on the outer side of the distal end of the inner leg of the first frame and having a second end on the inner side of the distal end of the outer leg with the first and second ends of the first latch member each extending along straight lines that are parallel but offset from each other, the first end of the latch member being rotatably fastened to the inner leg of the end frame and the second end of the latch member being releasably fastened to a rod; and a plurality of rods joining the first and second end frames at least adjacent the distal ends of some of the legs of each end frame and joining the first and second latch members, all of the rods joining the first and second end frames having the same length.

2. The laundry stand of claim 1, wherein the rods extend through the distal ends of the first and second legs of each end frame.

3. The laundry stand of claim 1, wherein the rods do not extend through the distal ends of the outer legs of each end frame.

4. The laundry stand of claim 1, wherein each latch member is formed from a first elongated member having a thickness of an inner leg and a second elongated member having a thickness of an outer leg, with the first and second elongated members joined together along an overlapping portion adjacent the second end, the first and second elongated members being parallel to each other.

5. The laundry stand of claim 1, wherein there are third and fourth end frames constructed like the first and second end frames, with the second and third end frames each having an upper distal end of an inner leg rotatably joined to a lower distal end of an outer leg of one of the first and second end frames, and further having an upper distal end of an outer leg rotatably joined to a lower distal end of an inner leg of one of the first and second end frames.

6. The laundry stand of claim 1, wherein there are a plurality of first and second end frames each having a an upper distal end of an inner leg rotatably joined to a lower distal end of an outer leg and further having an upper distal end of an outer leg rotatably joined to a lower distal end of an inner leg.

7. The laundry stand of claim 6, wherein the first end of each latch member is rotatably fastened to the upper distal end of the inner leg.

8. The laundry stand of claim 7, wherein the second end of each latch member is releasably fastened to a rod extending between the distal ends of the outer legs of the first and second end frames.

9. The laundry stand of claim 6, wherein the rods extend through the distal ends of the first and second legs of each end frame.

10. The laundry stand of claim 6, wherein the rods do not extend through the distal ends of the outer legs of each end frame.

11. The laundry stand of claim 6, wherein the outer legs and first end of the latch members of each end frame being in substantially the same first plane and the inner legs and second end of the latch members being in substantially the same second plane adjacent to but offset from the first plane.

12. The laundry stand of claim 6, wherein the rods connect to the end frames through connectors configured to fasten to an end of the rod and connect the rod to one of the end frames and the latch releasably connects to the connector second end of the latch member being releasably fastened to a rod at only an inner side of a leg of the first end frame and not alone an outer side of said leg to restrain the end frame from collapsing.

13. A kit for a collapsible laundry stand, comprising:

a plurality of pairs of inner and outer legs with each leg having an upper and lower end, each pair of legs having aligned bores through which each pair of legs are rotationally connected to form a plurality of scissor linkages, at least one end of each of the legs having corresponding bores through which cross-members can be connected to join two scissor linkages to form a first end frame having at least an upper and lower linkage, and at least two scissor linkages being joinable to form a second end frame having at least an upper and lower linkage, a plurality of cross-members of the same length having opposing distal ends;

a plurality of connectors configured to fasten one of the distal ends of a cross-member to one of the legs; and the first and second end frames each having respective first and second elongated latch members, each latch member having first and second opposing ends that are laterally offset from each other, the first end rotatably connected to an upper end of the inner leg on the upper scissor linkage and located on an outer side of that upper end, with the second end being placed adjacent an inner side of the upper end of the outer leg in the same scissor linkage as the first end during use and having one of a notch, hook or clip located to engage a cross-member or connector on the cross-member to restrain the end frame from collapsing during use, the second end of each latch member being adapted to connect to a cross member during use, each latch member having a plurality of aligned bores sized to connect to said cross members.

14. The kit of claim 13, further comprising a plurality of connectors having a first end configured to fasten to an end of a cross-member and a second end configured to fasten to a leg or latch member.

15. The kit of claim 13, wherein all of the connectors have the same length.

16. The kit of claim 14, wherein the latch member is formed from a first member having a thickness of an inner leg and a second member having a thickness of an outer leg, with the first and second members joined together along an overlapping portion adjacent the second end, the first and second members being parallel to each other.

17. A method for making a stabilized laundry stand having two opposing end frames comprising a plurality of scissor linkages with each linkage having an inner and an outer leg rotatably joined to expand for use and fold together to reduce space, with a plurality of cross members each extending between and fastened to each of the opposing end frames, the method comprising:

providing one end frame with a first latch member having a first end extending along a first axis and an opposing second end extending along a second axis parallel to but offset from the first axis;

rotatably connecting the first end to an upper end of an inner leg;

configuring the second end to be connected to a cross-member at the upper end of the outer leg on the same scissor linkage during use of the laundry stand, on an inner side of said outer leg on the same scissor linkage and not on the outer side of said outer leg;

providing the other end frame with a second latch member having a first end extending along a third axis and an opposing second end extending along a fourth axis parallel to but offset from the third axis;

rotatably connecting the first end of the second latch member to an upper end of an inner leg of the other end frame; and configuring the second end of the second latch member to be connected to a cross-member at the upper end of the outer leg on the same scissor linkage of the other end frame during use of the laundry stand, on an inner side of said outer leg on the same scissor linkage and not on the outer side of said outer leg; and providing a plurality of aligned bores in the latch members to fasten to the cross-members during use of the laundry stand.

18. The method of claim 17, further comprising:

providing a plurality of end connectors having a first end configured to fasten to an end of the cross-members and having a second opposing end configured to fasten to one of the legs or latch members, at least some of the end connectors configured to allow the latch members connect to the cross-members through at least some end connectors, and all of the end connectors having the same length.

19. The method of claim 17, further comprising:

providing all of the cross members that connect to the end frames and latch members of the same length.

20. The method of claim 17, further comprising:

folding the end frames together with the outer legs abutting another outer leg and one outer leg abutting the first end of one of the latch members, and with the inner legs abutting another inner leg and one inner leg abutting the second end of the latch member.

21. A collapsible laundry rack, comprising:

a first end frame having an inner and outer leg rotationally joined to fold generally parallel to each other in a collapsed configuration and to form an X shape in an expanded configuration, each leg having an upper end and a lower end;

a second end frame having an inner and outer leg rotationally joined to fold generally parallel to each other in a collapsed configuration and to form an X shape in an expanded configuration, each leg having an upper end and a lower end, the first and second end frames being generally parallel with the inner legs closer together than the outer legs and the outer legs being farther apart than the inner legs, each leg having an inner side facing toward the opposing end frame and an outer side facing away from the opposing end frame;

a first latch member having a first end on the outer side of the distal end of the inner leg of the first frame and having a second end on the inner side of the distal end of the outer leg with the first and second ends of the first latch member each extending along straight lines that are parallel but offset from each other, the first end of the latch member being rotatably fastened to the inner leg of the end frame and the second end of the latch member being releasably fastened to a rod at an inner side of a leg of the first end frame at only an inner side of a leg of the first end frame and not along an outer side of said leg to restrain the end frame from collapsing;

a second latch member having a first end on the outer side of the distal end of the inner leg of the first frame and having a second end on the inner side of the distal end of the outer leg with the first and second ends of the first latch member each extending along straight lines that are parallel but offset from each other, the first end of the latch member being rotatably fastened to the inner leg of the end frame and the second end of the latch member being releasably fastened to a rod at only an inner side of a leg of the first end frame and not along an outer side of said leg to restrain the end frame from collapsing; and a plurality of rods joining the first and second end frames at least adjacent the distal ends of some of the legs of each end frame and joining the first and second latch members, all of the rods joining the first and second end frames having the same length.

22. The laundry stand of claim 21, further including a plurality of connectors of the same length each interposed between an end of one rod and an end frame.

23. The laundry stand of claim 21, further including a plurality of connectors of the same length each interposed between an end of one rod and an end frame and configured to be received in a notch in the second end of each latch member.

24. The laundry stand of claim 1, wherein the rods connect to the end frames through connectors configured to fasten to an end of the rod and connect the rod to one of the end frames, the connectors having the same length.

25. The laundry stand of claim 1, wherein the rods connect to the end frames through connectors configured to fasten to an end of the rod and connect the rod to one of the end frames, the connectors configured to restrain rotation of the rods along an axis orthogonal to a longitudinal axis of the rod.

26. The laundry stand of claim 24, wherein the connectors are configured to restrain rotation of the rods along an axis orthogonal to a longitudinal axis of the rod.

27. The laundry stand of claim 1, wherein the rods connect to the end frames through connectors configured to fasten to an end of the rod and connect the rod to one of the end frames, the connectors being configured to restrain rotation of the rods along an axis orthogonal to a longitudinal axis of the rod.

28. The laundry stand of claim 1, wherein each latch member connects to at least two rods each having the same length, with a first of the two rods also connecting to an end frame on a first side of the offset and a second of the two rods connected on the other side of the offset and not connected to an end frame.

29. The laundry stand of claim 1, wherein each latch member is offset toward the opposing end frame an amount sufficient so that two rods each having the same length can join the latch members on opposing sides of the offset.

30. The laundry stand of claim 1, wherein the two rods join the latch members through connectors having the same length.

31. The method of claim 17, wherein all of the cross members that connect to the end frames are the same length, and further providing a plurality of end connectors having a first end configured to fasten to an end of the cross-members and having a second opposing end configured to fasten to one of the legs or latch members, the connectors being of the same length.

* * * * *